US008528663B2

(12) United States Patent
Boone

(10) Patent No.: US 8,528,663 B2
(45) **Date of Patent: *Sep. 10, 2013**

(54) APPARATUS AND METHODS FOR GUIDING TOOLFACE ORIENTATION

(75) Inventor: Scott G. Boone, Houston, TX (US)

(73) Assignee: Canrig Drilling Technology Ltd., Houston, TX (US)

( * ) Notice: Subject to any disclaimer, the term of this patent is extended or adjusted under 35 U.S.C. 154(b) by 347 days.

This patent is subject to a terminal disclaimer.

(21) Appl. No.: 12/855,035

(22) Filed: Aug. 12, 2010

(65) Prior Publication Data

US 2011/0024191 A1 Feb. 3, 2011

Related U.S. Application Data

(63) Continuation-in-part of application No. 12/339,350, filed on Dec. 19, 2008, now Pat. No. 7,802,634, and a continuation-in-part of application No. 12/390,229, filed on Feb. 20, 2009.

(51) Int. Cl.
*E21B 47/024* (2006.01)

(52) U.S. Cl.
USPC ..... 175/45; 702/9

(58) Field of Classification Search
USPC ..... 175/45, 61, 73; 702/9; 73/152.43, 73/152.46
See application file for complete search history.

(56) References Cited

U.S. PATENT DOCUMENTS

| | | | |
|---|---|---|---|
| 1,891,329 | A | 12/1932 | Le Compte et al. |
| 2,005,889 | A | 6/1935 | Dillon et al. |
| 2,724,574 | A | 11/1955 | Ledgerwood, Jr. |
| 3,223,183 | A | 12/1965 | Varney |
| 3,265,359 | A | 8/1966 | Bowden |
| 3,407,886 | A | 10/1968 | Bennett |
| 3,550,697 | A | 12/1970 | Hobhouse |
| 4,492,276 | A | 1/1985 | Kamp |
| 4,535,972 | A | 8/1985 | Millheim et al. |
| 4,662,608 | A | 5/1987 | Ball |
| 4,854,397 | A | 8/1989 | Warren et al. |

(Continued)

FOREIGN PATENT DOCUMENTS

| | | |
|---|---|---|
| EP | 0774563 B1 | 7/2002 |
| SU | 1668652 | 7/1991 |

(Continued)

OTHER PUBLICATIONS

Canrig's Answers to Omron Oilfield and Marine, Inc.'s First Set of Interrogatories, Civil Action No, 6:09-cv-00414, May 7, 2010.

(Continued)

*Primary Examiner* — Daniel P Stephenson
(74) *Attorney, Agent, or Firm* — Haynes and Boone, LLP

(57) ABSTRACT

Apparatus and methods for guiding a drilling operation are disclosed. The apparatus includes a drilling apparatus, a receiving apparatus, and a display apparatus. The drill apparatus includes a bit with a steerable motor having a toolface and a rotary drive adapted to steer the bit during the drilling operation. The receiving apparatus is adapted to receive electronic data on a recurring basis, wherein the electronic data comprises quill position data, at least one of actual gravity-based toolface orientation data and actual magnetic-based toolface orientation data, and recommended toolface orientation data. The display apparatus is adapted to display the electronic data on a user-viewable display in a historical format depicting data resulting from a recent measurement and a plurality of immediately prior measurements.

20 Claims, 5 Drawing Sheets

(56) References Cited

U.S. PATENT DOCUMENTS

| | | | | |
|---|---|---|---|---|
| 4,958,125 | A | 9/1990 | Jardine et al. | |
| 5,103,919 | A | 4/1992 | Warren et al. | |
| 5,103,920 | A | 4/1992 | Patton | |
| 5,205,163 | A | 4/1993 | Sananikone | |
| 5,358,059 | A | 10/1994 | Ho | |
| 5,390,748 | A | 2/1995 | Goldman | |
| 5,467,832 | A | 11/1995 | Orban et al. | |
| 5,474,142 | A | 12/1995 | Bowden | |
| 5,551,286 | A | 9/1996 | Booer | |
| 5,713,422 | A | 2/1998 | Dhindsa | |
| 5,730,234 | A | 3/1998 | Putot | |
| 5,738,178 | A | 4/1998 | Williams et al. | |
| 5,842,149 | A | 11/1998 | Harrell et al. | |
| 6,026,912 | A | 2/2000 | King et al. | |
| 6,029,951 | A | 2/2000 | Guggari | |
| 6,050,348 | A | 4/2000 | Richarson et al. | |
| 6,065,332 | A | 5/2000 | Dominick | |
| 6,092,610 | A | 7/2000 | Kosmala et al. | |
| 6,152,246 | A | 11/2000 | King et al. | |
| 6,155,357 | A | 12/2000 | King et al. | |
| 6,192,998 | B1 | 2/2001 | Pinckard | |
| 6,233,498 | B1 | 5/2001 | King et al. | |
| 6,293,356 | B1 | 9/2001 | King et al. | |
| 6,382,331 | B1 | 5/2002 | Pinckard | |
| 6,405,808 | B1 | 6/2002 | Edwards et al. | |
| 6,523,623 | B1 | 2/2003 | Schuh | |
| 6,757,613 | B2 | 6/2004 | Chapman et al. | |
| 6,802,378 | B2 | 10/2004 | Haci et al. | |
| 6,820,702 | B2 | 11/2004 | Niedermayr et al. | |
| 6,892,812 | B2 | 5/2005 | Niedermayr et al. | |
| 7,000,710 | B1 | 2/2006 | Umbach | |
| 7,032,689 | B2 | 4/2006 | Goldman et al. | |
| 7,044,239 | B2 | 5/2006 | Pinckard et al. | |
| 7,059,427 | B2 | 6/2006 | Power et al. | |
| 7,085,696 | B2 | 8/2006 | King | |
| 7,096,979 | B2 | 8/2006 | Haci et al. | |
| 7,243,735 | B2 | 7/2007 | Koederitz et al. | |
| 7,357,196 | B2 | 4/2008 | Goldman et al. | |
| 7,404,454 | B2 | 7/2008 | Hulick | |
| 7,546,209 | B2 | 6/2009 | Williams | |
| 7,584,788 | B2 | 9/2009 | Baron et al. | |
| 7,665,533 | B2 | 2/2010 | Hopwood et al. | |
| 7,775,297 | B2 | 8/2010 | Hopwood et al. | |
| 7,802,634 | B2 * | 9/2010 | Boone | 175/45 |
| 7,882,902 | B2 * | 2/2011 | Boutwell, Jr. | 175/40 |
| 2002/0104685 | A1 | 8/2002 | Pinckard et al. | |
| 2003/0051914 | A1 * | 3/2003 | Bittar | 175/45 |
| 2004/0028476 | A1 | 2/2004 | Payne et al. | |
| 2006/0185899 | A1 | 8/2006 | Alft et al. | |
| 2007/0203651 | A1 | 8/2007 | Blanz et al. | |
| 2008/0156531 | A1 | 7/2008 | Boone et al. | |
| 2008/0173480 | A1 | 7/2008 | Annaiyappa et al. | |
| 2008/0281525 | A1 | 11/2008 | Boone | |
| 2009/0058674 | A1 | 3/2009 | Papouras et al. | |
| 2009/0078462 | A1 | 3/2009 | Boone | |
| 2009/0090555 | A1 | 4/2009 | Boone et al. | |
| 2009/0159336 | A1 | 6/2009 | Boone | |
| 2009/0250264 | A1 | 10/2009 | Dupriest | |
| 2010/0121776 | A1 * | 5/2010 | Stenger | 705/347 |

FOREIGN PATENT DOCUMENTS

| | | |
|---|---|---|
| WO | WO 93/12318 | 6/1993 |
| WO | WO 2004/055325 | 7/2004 |
| WO | WO 2006/079847 | 8/2006 |
| WO | WO 2007/073430 | 6/2007 |
| WO | WO 2008/070829 | 6/2008 |
| WO | WO 2009/039448 | 3/2009 |
| WO | WO 2009/039453 | 3/2009 |

OTHER PUBLICATIONS

Canrig Drilling Technology Ltd,'s Objections and Responses to Helmerick & Payne's First Set of Interrogatories, Civil Action No. 6:09-cv-00414, Aug. 23, 2010.

Defendant's Joint Preliminary Claim Construction and Extrinsic Evidence, Civil Action No. 6:09-cv-00414LED, Sep. 24, 2010.

Plaintiff Canrig's Local Patent Rule 4-2 Disclosures, Civil Action No. 6:09-cv-00414, Sep. 24, 2010.

Joint Claim Construction Statement, Civil Action No. 6:09-cv-00414LED, Oct. 25, 2010.

U.S. Appl. No. 12/390,229, filed Feb. 20, 2009, Boone.

Young, Jr., "Computerized Drilling Control," *Journal of Petroleum Technology*, 21(4): 483-96 (1969).

Petroleum Extension Service, "Controlled Directional Drilling," N. Janicek (ed.), Third Edition, pp. 18-33 and 44-45, 1984.

Brett, et al., "Field Experiences with Computer-Controlled Drilling," *Society of Petroleum Engineers 20107*, presented at *Permian Basin Oil and Gas Recovery Cortference*, Midland, TX (Mar. 8-9, 1990).

Goldman, "Artificial Intelligence Applications Enhance Directional Control," *Petroleum Engineer International*, pp. 15-22, Feb. 1993.

Bonner, et al., "Measurements at the Bit: A New Generation of MWD Tools," *Oilfield Review*, pp. 44-54, Apr./Jul. 1993.

Jackson, et al., "Portable Top Drive Cuts Horizontal Drilling Costs," *World Oil Magazine*, vol. 214 Issue 11, pp. 81-89, Nov. 1993.

Murch, "Application of Top Drive Drilling to Horizontal Wells," Society of Petroleum Engineers—SPE 37100, 1996.

Gurari, E., "CIS 680: Data Structures: Chapter 19: Backtracking Algorithms;" http://www.cse.ohio-state,edu/%7Egurari/course/cis680/cis680Ch19.html (1999).

Brown, et al., "In-Time Data Delivery," *Oilfield Review*, 11(4): 34-55, http://www.slb.com/media/services/resources/oilfieldreview/ors99/win99/pages34_55.pdf (Winter 1999/2000).

Leine, et al., "Stick-Slip Whirl Interaction in Drillstring Dynamics," *J. of Vibration and Acoustics*, 124: 209-220 (2002).

Maidla, et al., "Understanding Torque: The Key to Slide-Drilling Directional Wells," IADC/SPE Drilling Conference, IADC/SPE 87162 (2004).

Dupriest, et al., "Maximizing Drill Rates with Real-Time Surveillance of Mechanical Specific Energy," SPE/IADC Drilling Conference 92194, Amsterdam, The Netherlands, p. 1-10 (Feb. 23-25, 2005).

Dupriest, F., "Maximizing ROP with Real-Time Analysis of Digital Data and MSE," International Petroleum Technology Conference, Doha, Qatar, p. 1-8 (Nov. 21-23, 2005).

Hartley, et al., "New Drilling Process Increases Rate of Penetration, Footage Per Day," *Offshore*, 66(1): 1-5 (2006).

Dupriest, F., "Comprehensive Drill-Rate Management Process to Maximize Rate of Penetration," SPE Annual Technology Conference and Exhibition, San Antonio, Texas, SPE 102210, p. 1-9 (Sep. 24-27, 2006).

"Wildcat ADS Automated Drilling System," Product Brochure, National Oilwell Varco, Inc. (2006).

The International Searching Authority, "Written Opinion of the International Searching Authority," PCT/US2007/86768, mailed Jun. 11, 2008.

Plaintiff's Original Complaint; Case 6:09-cv-00414; Doc. 1; Sep. 16, 2009.

"40223705-Series Wildcat Services Pneumatic Automated Drilling System," available at http://www.nov.com/Drilling/Control_and_Advisiory_Systems/Drawworks_Control_Auto_Drilling/Auto_Drillers.aspx (last visited Oct. 8, 2009).

Answer to Plaintiff's Complaint; Case 6:09-cv-00414-LED; Doc 25; Nov. 6, 2009.

Defendant Helmerich & Payne's Invalidity Contentions; Case 6:09-cv-00414-LED; Mar. 25, 2010.

Defendant Omron Oilfield and Marine, Inc's Patent Rule 3-3 Disclosures; Case 6:09-cv-00414-LED; Mar. 25, 2010.

Defendant Omron Oilfield and Marine, Inc's Patent Rule 3-4 Disclosures; Case 6:09-cv-00414-LED; Mar. 25, 2010.

Helmerich & Payne, Inc.'s First Amended Answer and Counterclaims to Plaintiff's Original Complaint; Case 6:09-cv-00414-LED; Doc 55; Mar. 25, 2010.

* cited by examiner 200 235 210 220 230 240 250

| Time | TFD | TFT +/− | TFM | Diff | Score |
|---|---|---|---|---|---|
| 12:01:32 | 25 | 10 | 25 | 0 | 10 |
| 14:01:32 | 25 | 10 | 27 | 2 | 8 |
| 16:01:32 | 25 | 10 | 27 | 2 | 8 |
| 18:01:32 | 25 | 10 | 28 | 3 | 7 |
| 20:01:32 | 25 | 10 | 30 | 5 | 5 |
| 22:01:32 | 25 | 10 | 35 | 10 | 0 |
| 24:01:32 | 25 | 10 | 31 | 6 | 4 |
| Total | | | | | 42 |

FIG.4

200 235 210 220 230 240 250 260 270

| Time | TFD | TFT +/− | TFM | Diff | Score |
|---|---|---|---|---|---|
| Driller 1 | | | | | |
| 07:01:32 | 25 | 10 | 25 | 0 | 10 |
| 09:01:32 | 25 | 10 | 27 | 2 | 8 |
| 11:01:32 | 25 | 10 | 27 | 2 | 8 |
| 13:01:32 | 25 | 10 | 28 | 3 | 7 |
| 15:01:32 | 25 | 10 | 30 | 5 | 5 |
| 17:01:32 | 25 | 10 | 35 | 10 | 0 |
| 19:01:32 | 25 | 10 | 31 | 6 | 4 |
| Total | | | | | 42 |
| Driller 2 | | | | | |
| 19:01:32 | 25 | 10 | 31 | 6 | 4 |
| 21:01:32 | 25 | 10 | 36 | 11 | 0 |
| 23:01:32 | 25 | 10 | 33 | 8 | 2 |
| 01:01:32 | 25 | 10 | 31 | 6 | 4 |
| 03:01:32 | 25 | 10 | 31 | 6 | 4 |
| 05:01:32 | 25 | 10 | 31 | 6 | 4 |
| 07:01:32 | 25 | 10 | 31 | 6 | 4 |
| Total | | | | | 22 |

FIG.5

300 335 310 320 330 340 350 360 370

| Time | IAD | IAT +/− | IAM | Diff | Score |
|---|---|---|---|---|---|
| Driller 1 | | | | | |
| 07:01:32 | 70 | 10 | 68 | 2 | 8 |
| 09:01:32 | 70 | 10 | 69 | 1 | 9 |
| 11:01:32 | 70 | 10 | 70 | 0 | 10 |
| 13:01:32 | 70 | 10 | 72 | 2 | 8 |
| 15:01:32 | 70 | 10 | 74 | 4 | 6 |
| 17:01:32 | 70 | 10 | 75 | 5 | 5 |
| 19:01:32 | 70 | 10 | 74 | 4 | 6 |
| Total | | | | | 52 |
| Driller 2 | | | | | |
| 19:01:32 | 70 | 10 | 74 | 4 | 6 |
| 21:01:32 | 70 | 10 | 73 | 3 | 7 |
| 23:01:32 | 70 | 10 | 70 | 0 | 10 |
| 01:01:32 | 70 | 10 | 68 | 2 | 8 |
| 03:01:32 | 70 | 10 | 67 | 3 | 7 |
| 05:01:32 | 70 | 10 | 66 | 4 | 6 |
| 07:01:32 | 70 | 10 | 68 | 2 | 8 |
| Total | | | | | 52 |

FIG.6

400 435 410 420 430 440 450 460 470

| Time | AAD | AAT +/− | AAM | Diff | Score |
|---|---|---|---|---|---|
| Driller 1 | | | | | |
| 07:01:32 | 70 | 10 | 68 | 2 | 8 |
| 09:01:32 | 70 | 10 | 69 | 1 | 9 |
| 11:01:32 | 70 | 10 | 70 | 0 | 10 |
| 13:01:32 | 70 | 10 | 72 | 2 | 8 |
| 15:01:32 | 70 | 10 | 74 | 4 | 6 |
| 17:01:32 | 70 | 10 | 75 | 5 | 5 |
| 19:01:32 | 70 | 10 | 74 | 4 | 6 |
| Total | | | | | 52 |
| Driller 2 | | | | | |
| 19:01:32 | 70 | 10 | 74 | 4 | 6 |
| 21:01:32 | 70 | 10 | 73 | 3 | 7 |
| 23:01:32 | 70 | 10 | 70 | 0 | 10 |
| 01:01:32 | 70 | 10 | 68 | 2 | 8 |
| 03:01:32 | 70 | 10 | 67 | 3 | 7 |
| 05:01:32 | 70 | 10 | 66 | 4 | 6 |
| 07:01:32 | 70 | 10 | 68 | 2 | 8 |
| Total | | | | | 52 |

FIG. 7

APPARATUS AND METHODS FOR GUIDING TOOLFACE ORIENTATION

CROSS-REFERENCE TO RELATED APPLICATIONS

This application is a continuation-in-part of U.S. application Ser. No. 12/339,350 filed Dec. 19, 2008 and a continuation-in-part of U.S. application Ser. No. 12/390,229 filed Feb. 20, 2009, the entire contents of each of which is hereby incorporated herein in its entirety by express reference thereto.

BACKGROUND

Underground drilling involves drilling a bore through a formation deep in the Earth using a drill bit connected to a drill string. During rotary drilling, the drill bit is typically rotated by a lop drive or other rotary drive means at the surface, where a quill and/or other mechanical means connects and transfers torque between the rotary drive mechanism and the drill string. During drilling, the drill bit is rotated by a drilling motor mounted in the drill string proximate the drill bit, and the drill string may or may not also be rotated by the rotary drive mechanism.

Drilling operations can be conducted on a vertical, horizontal, or directional basis. Vertical drilling typically refers to drilling in which the trajectory of the drill string is vertical, i.e., inclined at less than about 10° relative to vertical. Horizontal drilling typically refers to drilling in which the drill string trajectory is inclined horizontally, i.e., about 90° from vertical. Directional drilling typically refers to drilling in which the trajectory of the drill string is inclined directionally, between about 10° and about 90°. Correction runs generally refer to wells that are intended to be vertical but have deviated unintentionally and must be steered or directionally drilled back to vertical.

Various systems and techniques can be used to perform vertical, directional, and horizontal drilling. For example, steerable systems use a drilling motor with a bent housing incorporated into the bottom-hole assembly (BHA) of the drill string. A steerable system can be operated in a sliding mode in which the drill string is not rotated and the drill bit is rotated exclusively by the drilling motor. The bent housing steers the drill bit in the desired direction as the drill string slides through the bore, thereby effectuating directional drilling. Alternatively, the steerable system can be operated in a rotating mode in which the drill string is rotated while the drilling motor is running.

Rotary steerable tools can also be used to perform directional drilling. One particular type of rotary steerable tool can include pads or arms located on the drill string near the drill bit and extending or retracting at some fixed orientation during some or all of the revolutions of the drill string. Contact between the arms and the surface of the wellbore exerts a lateral force on the drill string near the drill bit, which pushes or points the drill bit in the desired direction of drilling.

Directional drilling can also be accomplished using rotary steerable motors which include a drilling motor that forms part of the BHA, as well as some type of steering device, such as the extendable and retractable arms discussed above. In contrast to steerable systems, rotary steerable motors permit directional drilling to be conducted while the drill string is rotating. As the drill string rotates, frictional forces are reduced and more bit weight is typically available for drilling. Hence, a rotary steerable motor can usually achieve a higher rate of penetration during directional drilling relative to a steerable system or a rotary steerable tool, since the combined torque and power of the drill string rotation and the downhole motor are applied to the bit.

Directional drilling requires real-time knowledge of the angular orientation of a fixed reference point on the circumference of the drill string in relation to a reference point on the wellbore. The reference point is typically magnetic north in a vertical well, or the high side of the bore in an inclined well. This orientation of the fixed reference point is typically referred to as toolface. For example, drilling with a steerable motor requires knowledge of the toolface so that the pads can be extended and retracted when the drill string is in a particular angular position, so as to urge the drill bit in the desired direction.

When based on a reference point corresponding to magnetic north, toolface is commonly referred to as magnetic toolface (MTF). When based on a reference point corresponding to the high side of the bore, toolface is commonly referred to as gravity tool face (GTF). GTF is usually determined based on measurements of the transverse components of the local gravitational field, i.e., the components of the local gravitational field perpendicular to the axis of the drill string. These components are typically acquired using an accelerometer and/or other sensing device included with the BHA. MTF is usually determined based on measurements of the transverse components of the Earth's local magnetic field, which are typically acquired using a magnetometer and/or other sensing device included with the BHA.

Obtaining, monitoring, and adjusting the drilling direction conventionally requires that the human operator must manually scribe a line or somehow otherwise mark the drill string at the surface to monitor its orientation relative to the downhole tool orientation. That is, although the GTF or MTF can be determined at certain time intervals, the top drive or rotary table orientation is not known automatically. Consequently, the relationship between toolface and the quill position can only be estimated by the human operator, or by using specialized drilling equipment such as that described in U.S. Publication No. 2009/0090555, filed Sep. 19, 2008, now assigned to Canrig Drilling Technology Ltd. It is known that this relationship is substantially affected by reactive torque acting on the drill string and bit.

It is understood in the art that directional drilling and/or horizontal drilling is not an exact science, and there are a number of factors that will cause a well to be drilled on or off course. The performances of the BHA are affected by downhole formations, the weight being applied to the bit (WOB), drilling fluid pump rates, and various other factors. Directional and/or horizontal wells are also affected by the engineering, as well as the execution of the well plan. There is not presently much attention paid to, much less an effective method of, guiding the driller at the controls of the drilling rig. Consequently, there has been a long-felt need to more accurately guide and help a driller to keep the tool face in the correct orientation, and to be able to direct the driller to keep the well on target, such as at the correct inclination and azimuth.

SUMMARY OF THE INVENTION

The present invention relates to an apparatus for guiding a drilling operation. The apparatus includes a drilling apparatus, a receiving apparatus, and a display apparatus. The drilling apparatus includes a bit with a steerable motor having a toolface and a rotary drive adapted to steer the bit during the drilling operation. The receiving apparatus is adapted to receive electronic data on a recurring basis, wherein the electronic data includes quill position data, at least one of actual gravity-based toolface orientation data and actual magnetic-based toolface orientation data, and recommended toolface orientation data. The display apparatus is adapted to display the electronic data on a user-viewable display in a historical format depicting data resulting from a recent measurement and a plurality of immediately prior measurements.

In one embodiment, the electronic data further includes actual azimuth toolface orientation data or actual inclination toolface orientation data, or a combination thereof. Preferably, the apparatus also includes a sensor configured to detect a drilling operation parameter indicative of a difference between the actual toolface orientation and the recommended toolface orientation. In another embodiment, the apparatus also includes a recorder to record the difference between the actual toolface orientation and the recommended toolface orientation.

In yet another embodiment, the display apparatus is further adapted to display the recommended tool face orientation data. The rotary drive typically includes a top drive or a kelly drive.

The present invention also relates to an apparatus for monitoring and guiding a drilling operation. The apparatus include a drilling apparatus, a human-machine interface adapted to facilitate monitoring the relationship between actual toolface orientation, quill position, and recommended toolface orientation of the drilling apparatus during a drilling operation, and a sensor configured to detect a drilling operation parameter indicative of a difference between the actual toolface orientation and the recommended toolface orientation.

In a preferred embodiment, the actual toolface orientation and recommended toolface orientation each independently include gravity-based toolface orientation data, magnetic-based toolface orientation data, azimuth toolface orientation data, inclination toolface orientation data, or a combination thereof. In another embodiment, the apparatus also includes a recorder to record the difference between the actual toolface orientation and the recommended toolface orientation. In yet another embodiment, the drilling apparatus includes a bottom hole assembly and a rotary drive apparatus. Preferably, the quill position relates the actual orientation of a portion of the rotary drive apparatus to the toolface.

The present invention further relates to a method of directing a drilling operation in a wellbore. The method includes operating a drilling apparatus, receiving and displaying electronic data, wherein the electronic data includes quill position data, actual toolface orientation data, and recommended toolface orientation data, and adjusting the drilling apparatus to move the toolface toward the recommended toolface orientation.

In one embodiment, the receiving and displaying electronic data is on a recurring basis. Preferably, the method also includes monitoring the difference between the actual toolface orientation and recommended toolface orientation. In another preferred embodiment, the method also includes recording the difference between the actual toolface orientation and recommended toolface orientation.

Generally, the recording occurs at regularly occurring length or depth intervals in the wellbore. In another embodiment, the method includes scoring the difference between the actual toolface orientation and recommended toolface orientation. In some embodiments, the method further includes providing the difference to an evaluator.

Preferably, adjusting the drilling apparatus includes adjusting the quill. In another embodiment, the actual toolface orientation data and recommended toolface orientation data each independently includes gravity-based toolface orientation data, magnetic-based toolface orientation data, azimuth toolface orientation data, inclination toolface orientation data, or a combination thereof.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

FIG. 4 is a schematic view of a drilling scorecard according to one or more aspects of the present disclosure;

FIG. 5 is a schematic view of a drilling scorecard according to one or more aspects of the present disclosure;

FIG. 6 is a schematic view of a drilling scorecard according to one or more aspects of the present disclosure; and FIG. 7 is a schematic view of a drilling scorecard according to one or more aspects of the present disclosure.

Figure 2:
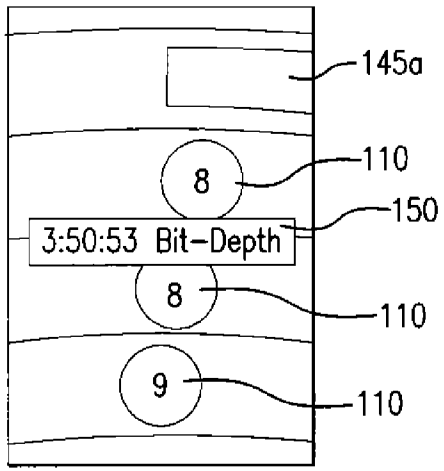
FIG. 2 is a magnified view of a portion of the display shown in FIG. 1.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

DETAILED DESCRIPTION OF PREFERRED EMBODIMENTS

It has been determined that displaying the relationship between the toolface, the quill position, and the recommended toolface orientation, i.e., toolface advisory, can be surprisingly useful in increasing accuracy of drilling. The driller can use this information to adjust the quill directly, or through another rotary drive device, to move the toolface in the correct direction. The driller can use self-feedback, or another person or computer can evaluate the accuracy of a given driller to help increase accuracy in future drilling operations. The general assumption is that the driller is not skilled in adequately maintaining the toolface orientation and this causes the well to be drilled off target. As a result, directional drillers are supplied to the job to supervise the rig's driller. A system, apparatus, or method according to aspects of the present invention can advantageously guide the driller in the right direction and reduce the number of off-target wells, or can help determine if the driller is at fault, or if unexpected formations or equipment failures or imminent failure may be the cause of inaccurate drilling.

Figure 1:
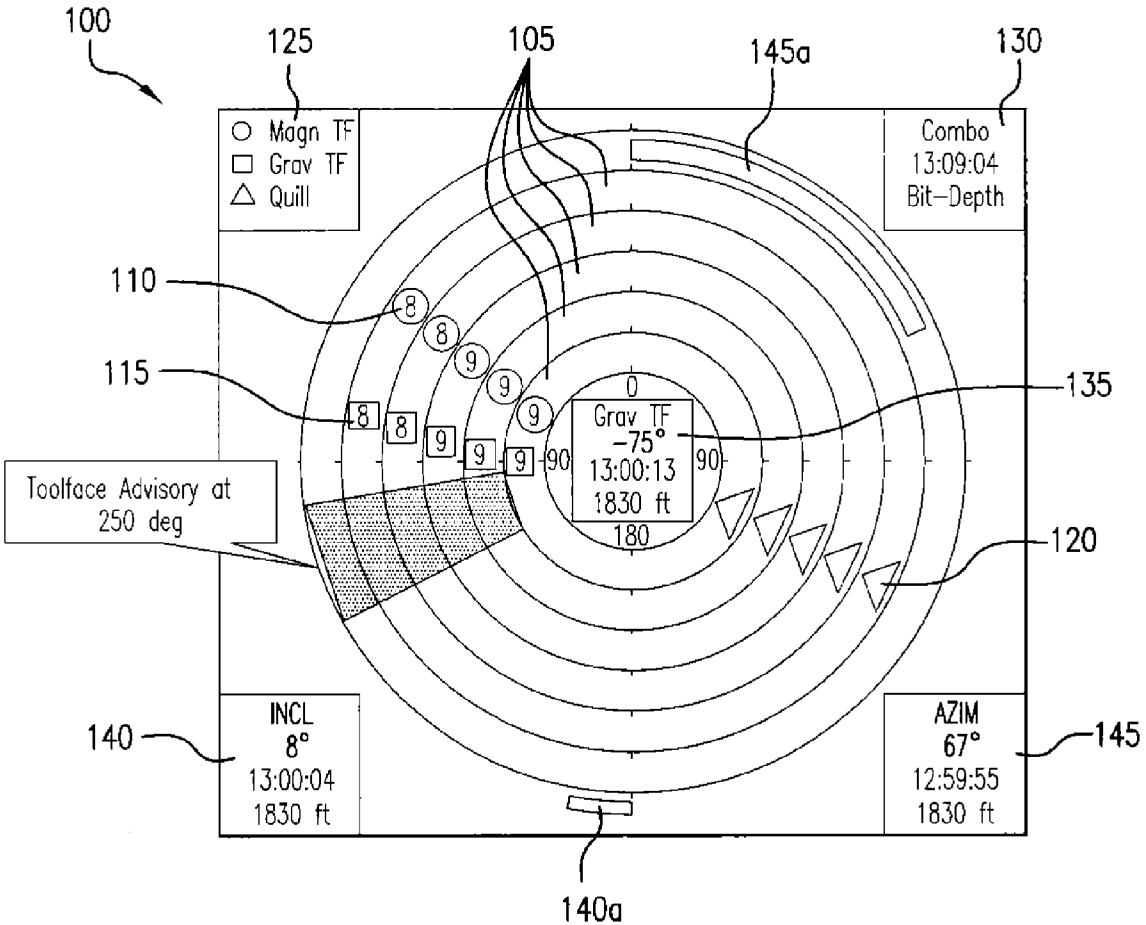
FIG. 1 is a schematic view of a display according to one or more aspects of the present disclosure.

Referring to FIG. 1, illustrated is a schematic view of a portion of a human-machine interface (HMI) 100 according to one or more aspects of the present disclosure. The HMI 100 may be utilized by a human operator during directional and/or other drilling operations to monitor the relationship between toolface orientation and quill position. In an exemplary embodiment, the HMI 100 is one of several display screens selectable by the user during drilling operations, and may be included as or in association with the human-machine interface(s), drilling operations and/or drilling apparatus described in one or more of U.S. Pat. No. 6,050,348, issued to Richardson, et al., entitled "Drilling Method and Apparatus;" or U.S. Publication No. 2009/0090555, or any of the applications or patents to which priority is claimed. The entire disclosure of each of these references is hereby incorporated herein in its entirety by express reference thereto. The HMI 100 may also be implemented as a series of instructions recorded on a computer-readable medium, such as described in one or more of these references.

The HMI 100 can be used by the directional driller while drilling to monitor the BHA in three-dimensional space. The control system or computer which drives one or more other human-machine interfaces during drilling operation may be configured to also display the HMI 100. Alternatively, the HMI 100 may be driven or displayed by a separate control system or computer, and may be displayed on a computer display (monitor) other than that on which the remaining drilling operation screens are displayed. In one embodiment, the control system is a closed loop control system that can operate automatically once a well plan is input to the HMI.

The control system or computer driving the HMI 100 can include a "survey" or other data channel, or otherwise can include an apparatus adapted to receive and/or read, or alternatively a means for receiving and/or reading, sensor data relayed from the BHA, a measurement-while-drilling (MWD) assembly, and/or other drilling parameter measurement means, where such relay may be, e.g., via the Wellsite Information Transfer Standard (WITS), WITS Markup Language (WITSML), and/or another data transfer protocol. Such electronic data may include gravity-based toolface orientation data, magnetic-based toolface orientation data, azimuth toolface orientation data, and/or inclination toolface orientation data, among others. In an exemplary embodiment, the electronic data includes magnetic-based toolface orientation data when the toolface orientation is less than about 7° relative to vertical, and alternatively includes gravity-based toolface orientation data when the toolface orientation is greater than about 7° relative to vertical. In other embodiments, however, the electronic data may include both gravity- and magnetic-based toolface orientation data. The toolface orientation data may relate the azimuth direction of the remote end of the drill string relative to magnetic North, wellbore high side, and/or another predetermined orientation. The inclination toolface orientation data may relate the inclination of the remote end of the drill string relative to vertical.

As shown in FIG. 1, the HMI 100 may be depicted as substantially resembling a dial or target shape having a plurality of concentric nested rings 105. In this embodiment, the magnetic-based toolface orientation data is represented in the HMI 100 by symbols 110, and the gravity-based toolface orientation data is represented by symbols 115. The HMI 100 also includes symbols 120 representing the quill position. In the exemplary embodiment shown in FIG. 1, the magnetic toolface data symbols 110 are circular, the gravity toolface data symbols 115 are rectangular, and the quill position data symbols 120 are triangular, thus distinguishing the different types of data from each other. Of course, other shapes or visualization tools may be utilized within the scope of the present disclosure. The symbols 110, 115, 120 may also or alternatively be distinguished from one another via color, size, flashing, flashing rate, and/or other graphic means.

The symbols 110, 115, 120 may indicate only the most recent toolface (110, 115) and quill position (120) measurements. However, as in the exemplary embodiment shown in FIG. 1, the HMI 100 may include a historical representation of the toolface and quill position measurements, such that the most recent measurement and a plurality of immediately prior measurements are displayed. Thus, for example, each ring 105 in the HMI 100 may represent a measurement iteration or count, or a predetermined time interval, or otherwise indicate the historical relation between the most recent measurement (s) and prior measurement(s). In the exemplary embodiment shown in FIG. 1, there are five such rings 105 in the dial (the outermost ring being reserved for other data indicia), with each ring 105 representing a data measurement or relay iteration or count. The toolface symbols 110, 115 may each include a number indicating the relative age of each measurement. In other embodiments, color, shape, and/or other indicia may graphically depict the relative age of measurement. Although not depicted as such in FIG. 1, this concept may also be employed to historically depict the quill position data.

The HMI 100 may also include a data legend 125 linking the shapes, colors, and/or other parameters of the data symbols 110, 115, 120 to the corresponding data represented by the symbols. The HMI 100 may also include a textual and/or other type of indicator 130 of the current tool face mode setting. For example, the toolface mode may be set to display only gravitational tool face data, only magnetic toolface data, or a combination thereof (perhaps based on the current toolface and/or drill string end inclination). The indicator 130 may also indicate the current system time. The indicator 130 may also identify a secondary channel or parameter being monitored or otherwise displayed by the HMI 100. For example, in the exemplary embodiment shown in FIG. 1, the indicator 130 indicates that a combination ("Combo") toolface mode is currently selected by the user, that the bit depth is being monitored on the secondary channel, and that the current system time is 13:09:04.

The HMI 100 may also include a textual and/or other type of indicator 135 displaying the current or most recent toolface orientation. The indicator 135 may also display the current toolface measurement mode (e.g., gravitational vs. magnetic). The indicator 135 may also display the time at which the most recent toolface measurement was performed or received, as well as the value of any parameter being monitored by a second channel at that time. For example, in the exemplary embodiment shown in FIG. 1, the most recent toolface measurement was measured by a gravitational toolface sensor, which indicated that the toolface orientation was −75°, and this measurement was taken at time 13:00:13 relative to the system clock, at which time the bit-depth was most recently measured to be 1830 feet.

The HMI 100 may also include a textual and/or other type of indicator 140 displaying the current or most recent inclination of the remote end of the drill string. The indicator 140 may also display the time at which the most recent inclination measurement was performed or received, as well as the value of any parameter being monitored by a second channel at that time. For example, in the exemplary embodiment shown in FIG. 1, the most recent drill string end inclination was 8°, and this measurement was taken at time 13:00:04 relative to the system clock, at which time the bit-depth was most recently measured to be 1830 feet. The HMI 100 may also include an additional graphical or other type of indicator **140*a* displaying the current or most recent inclination. Thus, for example, the HMI 100 may depict the current or most recent inclination with both a textual indicator (e.g., indicator 140) and a graphical indicator (e.g., indicator 140*a*). In the embodiment shown in FIG. 1, the graphical inclination indicator 140*a*** represents the current or most recent inclination as an arcuate bar, where the length of the bar indicates the degree to which the inclination varies from vertical.

The HMI 100 may also include a textual and/or other type of indicator 145 displaying the current or most recent azimuth orientation of the remote end of the drill string. The indicator 145 may also display the time at which the most recent azimuth measurement was performed or received, as well as the value of any parameter being monitored by a second channel at that time. For example, in the exemplary embodiment shown in FIG. 1, the most recent drill string end azimuth was 67°, and this measurement was taken at time 12:59:55 relative to the system clock, at which time the bit-depth was most recently measured to be 1830 feet. The HMI 100 may also include an additional graphical or other type of indicator 145*a* displaying the current or most recent inclination. Thus, for example, the HMI 100 may depict the current or most recent inclination with both a textual indicator (e.g., indicator 145) and a graphical indicator (e.g., indicator 145*a*). In the embodiment shown in FIG. 1, the graphical azimuth indicator 145*a* represents the current or most recent azimuth measurement as an arcuate bar, where the length of the bar indicates the degree to which the azimuth orientation varies from true North or some other predetermined position.

As shown in FIG. 1, an example of a toolface advisory sector is displayed showing an example toolface advisory of 250 degrees. In this example, this is the preferred angular zone within which the driller or directional driller, or automated drilling program, should endeavor to keep his, or its, toolface readings. Preferably, the driller will adjust the settings on the drilling apparatus to keep it within this zone.

Referring to FIG. 2, illustrated is a magnified view of a portion of the HMI 100 shown in FIG. 1. In embodiments in which the HMI 100 is depicted as a dial or target shape, the most recent toolface and quill position measurements may be closest to the edge of the dial, such that older readings may step toward the middle of the dial. For example, in the exemplary embodiment shown in FIG. 2, the last reading was 8 minutes before the currently-depicted system time, the next reading was also received in the $8^{th}$ minute before the currently-depicted system time, and the oldest reading was received in the $9^{th}$ minute before the currently-depicted system time. Readings that are hours or seconds old may indicate the length/unit of time with an "h" for hours or a format such as ":25" for twenty five seconds before the currently-depicted system time.

As also shown in FIG. 2, positioning the user's mouse pointer or other graphical user-input means over one of the toolface or quill position symbols 110, 115, 120 may show the symbol's timestamp, as well as the secondary indicator (if any), in a pop-up window 150. Timestamps may be dependent upon the device settings at the actual time of recording the measurement. The toolface symbols 110, 115 may show the time elapsed from when the measurement is recorded by the sensing device (e.g., relative to the current system time). Secondary channels set to display a timestamp may show a timestamp according to the device recording the measurement.

In the embodiment shown in FIGS. 1 and 2, the HMI 100 shows the absolute quill position referenced to true North, hole high-side, or to some other predetermined orientation. The HMI 100 also shows current and historical toolface data received from the downhole tools (e.g., MWD). The HMI 100, other human-machine interfaces within the scope of the present disclosure, and/or other tools within the scope of the present disclosure may have, enable, and/or exhibit a simplified understanding of the effect of reactive torque on toolface measurements, by accurately monitoring and simultaneously displaying both toolface and quill position measurements to the user.

Figure 3:
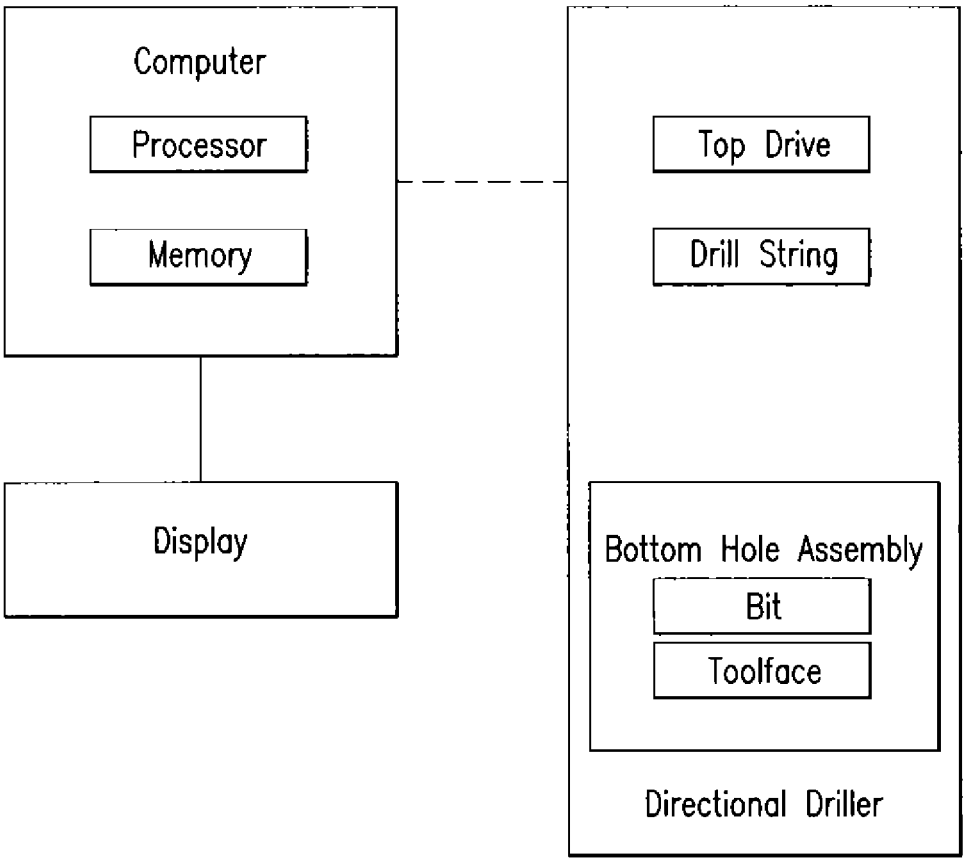
FIG. 3 is a block diagram of a system including a display and a cooperating directional driller and computer according to one or more aspects of the present disclosure.

FIG. 3 is a block diagram of a system including the display and a cooperating directional driller and computer. The directional driller includes a top drive that may include a quill and includes a BHA with a bit and a steerable motor with toolface. A drill string is disposed between the BHA and the top drive. The directional driller is in communication with a computer having a memory and processor and data representing the quill position and the toolface orientation is communicated from the directional driller on an ongoing basis to the computer. The computer processes the data and preferably displays data on the display in the manner discussed herein.

In view of the above, the Figures, and the references incorporated herein, those of ordinary skill in the art should readily understand that the present disclosure introduces a method of visibly demonstrating a relationship between toolface orientation and quill position, such method including: (1) receiving electronic data preferably on an on-going basis, wherein the electronic data includes quill position data and at least one of gravity-based toolface orientation data and magnetic-based toolface orientation data; and (2) displaying the electronic data on a user-viewable display in a historical format depicting data resulting from a most recent measurement and a plurality of immediately prior measurements. The electronic data may further include azimuth data, relating the azimuth orientation of the drill string adjacent the bit. The distance between the bit and sensor(s) gathering the electronic data is preferably as small as possible while still obtaining at least sufficiently, or entirely, accurate readings, and the minimum distance necessary to obtain accurate readings without drill bit interference will be known or readily determined by those of ordinary skill in the art. The electronic data may further include toolface azimuth data, relating the azimuth orientation of the drill string near the bit. The electronic data may further include toolface inclination data, relating the inclination of the drill string near the bit. The quill position data may relate the orientation of the quill, top drive, kelly, and/or other rotary drive means or mechanism to the bit and/or toolface. The electronic data may be received from MWD and/or other downhole sensor/measurement equipment or means.

The method may further include associating the electronic data with time indicia based on specific times at which measurements yielding the electronic data were performed. In an exemplary embodiment, the most current data may be displayed textually and older data may be displayed graphically, such as a preferably dial- or target-shaped representation. In other embodiments, different graphical shapes can be used, such as oval, square, triangle, or shapes that are substantially similar but with visual differences, e.g., rounded corners, wavy lines, or the like. Nesting of the different information is preferred. The graphical display may include time-dependent or time-specific symbols or other icons, which may each be user-accessible to temporarily display data associated with that time (e.g., pop-up data). The icons may have a number, text, color, or other indication of age relative to other icons. The icons preferably may be oriented by time, newest at the dial edge, oldest at the dial center. In an alternative embodiment, the icons may be oriented in the opposite fashion, with the oldest at the dial edge and the newer information towards the dial center. The icons may depict the change in time from (1) the measurement being recorded by a corresponding sensor device to (2) the current computer system time. The display may also depict the current system time.

The present disclosure also introduces an apparatus including: (1) apparatus adapted to receive, or a means for receiving, electronic data on an on-going basis or alternatively a recurring basis, wherein the electronic data includes quill position data and at least one of gravity-based toolface orientation data and magnetic-based toolface orientation data; and (2) apparatus adapted to display, or a means for displaying, the electronic data on a user-viewable display in a historical format depicting data resulting from a most recent measurement and a plurality of immediately prior measurements.

Embodiments within the scope of the present disclosure may offer certain advantages over the prior art. For example, when toolface and quill position data are combined on a single visual display, it may help an operator or other human personnel to understand the relationship between toolface and quill position, and help the operator adjust the drilling apparatus to move the toolface in the correct direction. Combining toolface and quill position data on a single display may also or alternatively aid understanding of the relationship that reactive torque has with toolface and/or quill position. These advantages may be recognized during vertical drilling, horizontal drilling, directional drilling, and/or correction runs. For example, the quill can be rotated back and forth, or "rocked," through a desired toolface position about ⅛ to about 8 revolutions in each direction, preferably through about ½ to about 4 revolutions, to decrease the friction in the well during drilling. In one embodiment, the quill can oscillate 5 revolutions in each direction. This rocking can advantageously be achieved by knowledge of the quill position, particularly when taken in combination with the toolface position data.

In this embodiment, the downhole tool and the top drive at the surface can be operatively associated to facilitate orientation of the toolface. The WOB can be increased or decreased and torqued to turn the pipe and therefore pull the toolface around to a new direction as desired. In a preferred embodiment, back and forth rocking can be automated and used to help steer drilling by setting a target, e.g., 1000 ft north of the present location, and having the HMI direct the drill towards that target. When the actual drilling is manual, the scoring discussed herein can be tracked and applied to make improved drilling a challenging game rather than merely a job task. According to an embodiment of the invention, the oscillation can be asymmetrical, which can advantageously facilitate turning the toolface and the drilling to a different direction. For example, the pipe can be rotated 4 revolutions clockwise and then 6 counter-clockwise, or 7 times clockwise and then 3 counter-clockwise, and then generally as needed randomly or in a pattern to move the drilling bearing closer to the direction of the target. This rocking can all be achieved without altering the WOB. The asymmetrical degree of oscillation can be reduced as the toolface and drilling begin to approach the desired pre-set heading towards the target. Thus, for example, the rocking may begin with 4 clockwise and 6 counter-clockwise, then become 4½ and 5½, then become symmetrical once a desired heading is achieved. Additional points in between at ⅛ or ¼ revolution increments (or larger, like ½ or 1) may be selected to more precisely steer the drilling to a target heading.

Referring to FIG. 4, in an exemplary embodiment, a scorecard 200 may be used to more accurately evaluate a driller's ability to keep the toolface in the correct orientation. The scorecard 200 may be implemented as a series of instructions recorded on a computer-readable medium. In an alternative embodiment, the scorecard may be implemented in hardcopy, such as in a paper notebook, an easel, or on a whiteboard or posting board on a wall. A desired or toolface advisory TFD 210 may be determined to steer the well to a target or along a well plan. The TFD 210 may be entered into the scorecard 200 from the rigsite or remotely, such as, for example, over an internet connection. The TFD 210 may also have an acceptable minimum and maximum tolerance TFT 220, which may be entered into the scorecard 200 from the rigsite or remotely. A measured toolface angle TFM 230 may be received from the BHA, MWD, and/or other drilling parameter measurement means. The TFM 230 may include gravity-based toolface orientation, magnetic-based toolface orientation data, and/or gyroscopic toolface orientation data. These measurements may be made downhole, stored in solid-state memory for some time, and downloaded from the instrument(s) at the surface and/or transmitted to the surface. Data transmission methods may include any available method known to those of ordinary skill in the art, for example, digitally encoding data and transmitting the encoded data to the surface, as pressure pulses in the drilling fluid or mud system, acoustic transmission through the drill string, electronically transmitted through a wireline or wired pipe, and/or transmitted as electromagnetic pulses. The data relay may be via the WITS, WITSML, and/or another data transfer protocol. The measurement performed by the sensors described above may be performed once, continuously, periodically, and/or at random intervals. The measurement may be manually triggered by an operator or other person accessing a human-machine interface (HMI), or automatically triggered by, for example, a triggering characteristic or parameter satisfying a predetermined condition (e.g., expiration of a time period, drilling progress measured by reaching a predetermined depth or bit length, drill bit usage reaching a predetermined amount, etc.). In an exemplary embodiment, the measurement is taken every two hours and the time 235 is displayed for every measurement. The difference 240 between TFD 210 and TFM 230 may be displayed, or, alternatively, or in addition to, the percent difference between TFD and TFM may be displayed. A further embodiment would be to score any toolface reading acquired as being inside or outside the toolface advisory sector, which could preferably be scored to provide a score based on the number of toolface results received that are inside the toolface advisory sector compared to the total number of toolface results received, expressed as a percentage or fraction. In an exemplary embodiment, the difference 240 may result in a score 250 for each time 235. The score 250 may be calculated to provide a higher amount of points for the TFM 230 being closer to the TFD 210. For example, 10 points may be awarded for being on target, 5 points for being 5 degrees off target, 0 points for being 10 degrees or more off target. Variations within 0-5 and 5-10 degrees can be linear, or can be arranged to drop off more steeply in non-linear fashion the further off target the result. For example, 10 points may be awarded for being on target, 8 points for being 1 degree off target, 5 points for being 2 degrees off target, 1 point for being 3 degrees off target, and no points for more inaccurate drilling. The scoring can be varied over time, such as to normalize scores based on length of time drilling on a given day. As another alternative, the scoring at each time can be arranged so that the penalty is minimal within the toolface tolerance TFM 230, e.g., where the difference 240 is less than the TFM 230, the score is the maximum possible or the score decreases at a slower rate than when the difference 240 is greater than the TFM 230. For example, 1 point can be deducted from the maximum score per 1 degree within the tolerance, versus a deduction of 2 points from the maximum per 1 degree outside the tolerance. Any of the plethora of alternative scoring methods are also within the scope of the present disclosure using these embodiments as a guide. In an exemplary embodiment, the current score 250 may be displayed on the HMI 100 as the drilling operation is conducted.

Referring to FIG. 5, in an exemplary embodiment, the scorecard 200 may be kept for various drillers that may occupy the controls of the drilling rig, for example, a day shift driller 260 and a night shift driller 270 could compete to see who could accumulate the most points. Alternatively or in addition to, a scorecard 200 may be kept for an automated drilling program, such as, for example, the Rockit™ Pilot available from Nabors Industries to compare to a human driller's record to evaluate if human drillers can achieve, exceed, or minimize differences from, the scores achieved by such automated drilling equipment working off a well plan. The scorecard 200 could be used as part of an incentive program to reward accurate drilling performance, either through peer recognition, financial rewards (e.g., adjusted upwards or downwards), or both.

Referring to FIG. 6, in an exemplary embodiment, a scorecard 300 may be used to more accurately evaluate a driller's ability to keep the BHA in the correct inclination. A desired or target inclination angle IAD 310 may be determined to steer the well to a target or along a well plan. The IAD 310 may be entered into the scorecard 300 from the rigsite or remotely, such as, for example, over an internet connection. The IAD 310 may also have an acceptable minimum and maximum tolerance IAT 320 which may be entered into the scorecard 300 from the rigsite or remotely. The measured inclination angle IAM 330 may be received from the BHA, MWD, and/or other drilling parameter measurement means. In an exemplary embodiment, the measurement is taken every two hours and the time 335 is displayed for every measurement. The difference 340 between IAD 310 and IAM 330 may be displayed, or, alternatively, or in addition to, the percent difference between TFD and TFM may be displayed. In an exemplary embodiment, the difference 340 may result in a score 350 for each time 335. The score 350 may be calculated to provide a higher amount of points for the IAM 330 being closer to the IAD 310. For example, 10 points may be awarded for being on target, 5 points for being 5 degrees off target, 0 points for being 10 degrees or more off target. Alternative scoring methods are also within the scope of the present disclosure, including without limitation any of those noted above. The scorecard 300 may be kept for various drillers that may occupy the controls of the drilling rig, for example as noted herein.

Alternatively or in addition to, the scorecard 300 may be kept for an automated drilling program, such as, for example, the Rockit™ Pilot available from Nabors Industries. The scorecard 300 could be used as part of an incentive program to reward accurate drilling performance, as noted herein. Alternatively, or in addition, the score 350 may be displayed on the HMI 100. The automated drilling system can be scored against itself, or alternatively, itself under various drilling conditions, based on certain types of geologic formations, or the like. The automated drilling system can also, in one embodiment, be compared against human drillers on the same rig.

Referring to FIG. 7, in an exemplary embodiment, a scorecard 400 may be used to more accurately evaluate a driller's ability to keep the BHA in the correct azimuth. A desired or target azimuth angle AAD 410 may be determined to steer the well to a target or along a well plan. The AAD 410 may be entered into the scorecard 400 from the rigsite or remotely, such as, for example, over an internet connection. The AAD 410 may also have an acceptable minimum and maximum tolerance AAT 420 which may be entered into the scorecard 400 from the rigsite or remotely. The measured azimuth angle AAM 430 may be received from the BHA, MWD, and/or other drilling parameter measurement means. In an exemplary embodiment, the measurement is taken every two hours and the time 435 is displayed for every measurement. The difference 440 between AAD 410 and AAM 430 may be displayed, or, alternatively, or in addition to, the percent difference between AAD and AAM may be displayed. In an exemplary embodiment, the difference 440 may result in a score 450 for each time 435. The score 450 may be calculated to provide a higher amount of points for the AAM 430 being closer to the AAD 410 according to any of the methods discussed herein. Alternative scoring methods are also within the scope of the present disclosure. The scorecard 400 may be kept for various drillers as discussed herein. Alternatively or in addition to, the scorecard 400 may be kept for an automated drilling program, such as, for example, the Rockit™ Pilot available from Nabors Industries. The scorecard 400 could be used as part of an incentive program to reward accurate drilling performance, as discussed herein. Alternatively, the scoring can be used to help determine the need for training. In another embodiment, the scoring can help determine the cause of drilling errors, e.g., equipment failures or inaccuracies, the well plan, the driller and human drilling error, or unexpected underground formations, or some combination of these reasons. Alternatively, or in addition, the score 350 may be displayed on the HMI 100.

In an exemplary embodiment, a scorecard could include one or more scorecards 200, 300 and/or 400 or information from one or more of these scorecards in any suitable arrangement to track progress in drilling accuracy. Alternatively, or in addition, the score 250, 350, or 450 may be displayed on the HMI 100. This progress can include that for a single driller over time, for two or more drillers on the same rig or working on the same well plan, or for a team of drillers, e.g., those drilling in similar underground formations. Other embodiments within the scope of the present disclosure may use additional or alternative measurement parameters, such as, for example, depth, horizontal distance from the target, vertical distance from the target, time to reach the target, vibration, length of pipe in the targeted reservoir, and length of pipe out of the targeted reservoir. In an exemplary embodiment, the method can include or can further include monitoring an actual weight parameter associated with a downhole steerable motor (e.g., measured near the motor, such as within about 100 feet), monitoring a weight parameter measured at the surface, recording the actual weight on bit parameter, recording the weight parameter measured at the surface, recording the difference between the actual weight on bit parameter and a desired weight on bit parameter, and scoring the difference between the actual weight on bit parameter and the desired weight on bit parameter. The weight parameter measured at the surface may be compared to the actual weight on bit parameters to gain an understanding of the relationship between surface weight and actual weight on the bit. This relationship will provide an ability to drill ahead using downhole data to manage feedoff of an autodriller or a driller.

Furthermore, scoring could also be affected by drilling occurrences, such as mud motor stalls or unplanned equipment sidetracks or the need to withdraw the entire drill string, which would typically carry a heavy scoring penalty.

In view of the above, the Figures, and the references incorporated herein, those of ordinary skill in the art should readily understand that the present disclosure introduces a method of guiding or steering drilling of a wellbore, the method including: (1) monitoring an actual toolface orientation of the downhole steerable motor by monitoring a drilling operation parameter indicative of a difference between the actual toolface orientation and a toolface advisory; and (2) adjusting the drilling apparatus to move the toolface in the toolface advisory. The methods can alternatively or additionally be used to evaluate performance during drilling. The method optionally includes (3) recording the difference between the actual toolface orientation and a toolface advisory; and (4) scoring the difference between the actual toolface orientation and a toolface advisory. The recording the difference between the actual toolface orientation and a toolface advisory may be performed at regularly occurring time intervals and/or at regularly occurring length intervals. The scoring the difference between the actual toolface orientation and a toolface advisory may be performed for various drillers that may occupy the controls of the drilling rig.

The method may further or alternatively include: (1) monitoring an actual inclination angle of a downhole steerable motor by monitoring a drilling operation parameter indicative of a difference between the actual inclination angle and a desired inclination angle; (2) recording the difference between the actual inclination angle and a desired inclination angle; and (3) scoring the difference between the actual inclination angle and a desired inclination angle. The method may further or alternatively include: (1) monitoring an actual azimuthal angle of the downhole steerable motor by monitoring a drilling operation parameter indicative of a difference between the actual azimuthal angle and a desired azimuthal angle; (2) recording the difference between the actual azimuthal angle and a desired azimuthal angle; and (3) scoring the difference between the actual azimuthal angle and a desired azimuthal angle.

The present disclosure also introduces an apparatus for evaluating performance in drilling a wellbore, the apparatus including: (1) a sensor configured to detect a drilling operation parameter indicative of a difference between the actual toolface orientation of a downhole steerable motor and a toolface advisory; and optionally, but preferably, (2) a controller configured to score the difference between the actual toolface orientation and a toolface advisory. The apparatus may further include: a recorder to record the difference between the actual toolface orientation and a toolface advisory. The apparatus may further include: (1) a sensor configured to detect a drilling operation parameter indicative of a difference between the actual inclination angle and a desired inclination angle and (2) a controller configured to score the difference between the actual inclination angle and a desired inclination angle. The apparatus may further include: (1) a sensor configured to detect a drilling operation parameter indicative of a difference between the actual azimuthal angle and a desired azimuthal angle; and (2) a controller configured to score the difference between the actual azimuthal angle and a desired azimuthal angle.

The present disclosure also introduces a system for evaluating drilling performance, the system including means for monitoring an actual toolface orientation of the downhole steerable motor by monitoring a drilling operation parameter indicative of a difference between the actual toolface orientation and a toolface advisory, means for recording the difference between the actual toolface orientation and the toolface advisory, means for scoring the difference between the actual toolface orientation and the toolface advisory by assigning a value to the difference that is representative of drilling accuracy and varies depending on the difference; and, optionally but preferably, means for providing the value to an evaluator. The means for providing the value may include, i.e., a printout, an electronic display, or the like, and the value may be simply the score or it may be or include a comparison based on further calculations using the value compared to values from the same driller, another driller, or an automated drilling program on the same day, at the same rigsite, or another variable where drilling accuracy is desired to be compared.

In one embodiment, the invention can also encompass a method of evaluating an automated drilling system that takes control of the establishing and maintaining the toolface, as well as driller job performance in a wellbore, by monitoring the actual toolface orientation of a tool, such as a downhole steerable motor assembly, by monitoring a drilling operation parameter indicative of a difference between the actual toolface orientation and a toolface advisory, recording the difference between the actual toolface orientation and the toolface advisory, and scoring the difference between the actual toolface orientation and the toolface advisory by assigning a value to the difference that represents drilling performance and varies depending on the difference. Optionally, but preferably, the values between the automated drilling system and the driller job performance can be compared to provide a difference. Preferably, the invention further encompasses providing the value or values to an evaluator.

The present invention encompasses systems, apparatus, and methods for guiding or directing a drilling operation. The recommended toolface orientation, i.e., toolface advisory, may be used either with or without the scoring discussed in the present disclosure.

The term "quill position," as used herein, may refer to the static rotational orientation of the quill relative to the rotary drive, magnetic North, and/or some other predetermined reference. "Quill position" may alternatively or additionally refer to the dynamic rotational orientation of the quill, such as where the quill is oscillating in clockwise and counterclockwise directions about a neutral orientation that is substantially midway between the maximum clockwise rotation and the maximum counterclockwise rotation, in which case the "quill position" may refer to the relation between the neutral orientation or oscillation midpoint and magnetic North or some other predetermined reference. Moreover, the "quill position" may herein refer to the rotational orientation of a rotary drive element other than the quill conventionally utilized with a top drive. For example, the quill position may refer to the rotational orientation of a rotary table or other surface-residing component utilized to impart rotational motion or force to the drill string. In addition, although the present disclosure may sometimes refer to a display integrating quill position and toolface orientation, such reference is intended to further include reference to a display integrating drill string position or orientation at the surface with the downhole toolface orientation.

The term "about," as used herein, should generally be understood to refer to both numbers in a range of numerals. Moreover, all numerical ranges herein should be understood to include each whole integer within the range.

The foregoing outlines features of several embodiments so that those of ordinary skill in the art may better understand the aspects of the present disclosure. Those of ordinary skill in the art should appreciate that they may readily use the present disclosure as a basis for designing or modifying other processes and structures for carrying out the same purposes and/or achieving the same advantages of the embodiments introduced herein. Those of ordinary skill in the art should also realize that such equivalent constructions do not depart from the spirit and scope of the present disclosure, and that they may make various changes, substitutions and alterations herein without departing from the spirit and scope of the present disclosure. Moreover, it will be understood that the appended claims are intended to cover all such expedient modifications and embodiments that come within the spirit and scope of the present invention, including those readily attainable by those of ordinary skill in the art from the disclosure set forth herein.

What is claimed is:

1. An apparatus for guiding a drilling operation comprising:

a drilling apparatus comprising a bit with a steerable motor having a toolface and a rotary drive adapted to steer the bit during the drilling operation;

a receiving apparatus adapted to receive electronic data on a recurring basis, wherein the electronic data comprises quill position data, at least one of actual gravity-based toolface orientation data and actual magnetic-based toolface orientation data, and recommended toolface orientation data; and a display apparatus adapted to display the electronic data on a user-viewable display in a historical format depicting data resulting from a recent measurement and a plurality of immediately prior measurements.

2. The apparatus of claim 1, wherein the electronic data further comprises actual azimuth toolface orientation data or actual inclination toolface orientation data, or a combination thereof.

3. The apparatus of claim 1, further comprising a sensor configured to detect a drilling operation parameter indicative of a difference between the actual toolface orientation and the recommended toolface orientation.

4. The apparatus of claim 1, further comprising a recorder to record the difference between the actual toolface orientation and the recommended toolface orientation.

5. The apparatus of claim 1, wherein the display apparatus is further adapted to display the recommended toolface orientation data.

6. The apparatus of claim 1, wherein the rotary drive includes a top drive or a kelly drive.

7. An apparatus for monitoring and guiding a drilling operation, comprising:

a drilling apparatus comprising a bit with a steerable motor having a toolface and a rotary drive adapted to steer the bit during the drilling operation;

a receiving apparatus adapted to receive electronic data on a recurring basis, wherein the electronic data comprises quill position data, at least one of actual gravity-based toolface orientation data and actual magnetic-based toolface orientation data, and recommended toolface orientation data;

a display apparatus adapted to display the electronic data on a user-viewable display in a historical format depicting data resulting from a recent measurement and a plurality of immediately prior measurements;

a sensor configured to detect a drilling operation parameter indicative of a difference between the actual toolface orientation and the recommended toolface orientation.

8. The apparatus of claim 7, wherein the recommended toolface orientation independently comprises gravity-based toolface orientation data, magnetic-based toolface orientation data, azimuth toolface orientation data, or a combination thereof.

9. The apparatus of claim 7, further comprising a recorder to record the difference between the actual tool face orientation and the recommended toolface orientation.

10. The apparatus of claim 7, wherein the drilling apparatus comprises a bottom hole assembly and a rotary drive apparatus.

11. The apparatus of claim 10, wherein the quill position relates the actual orientation of a portion of the rotary drive apparatus to the toolface.

12. A method of directing a drilling operation in a wellbore comprising:

operating a drilling apparatus;

receiving and displaying electronic data, wherein the electronic data includes quill position data, actual toolface orientation data, and recommended toolface orientation data; and adjusting the drilling apparatus to move the toolface toward the recommended toolface orientation.

13. The method of claim 12, wherein the receiving and displaying electronic data is on a recurring basis.

14. The method of claim 12, further comprising monitoring the difference between the actual toolface orientation and recommended toolface orientation.

15. The method of claim 14, further comprising recording the difference between the actual toolface orientation and recommended toolface orientation.

16. The method of claim 15, wherein the recording occurs at regularly occurring length or depth intervals in the wellbore.

17. The method of claim 16, further comprising scoring the difference between the actual toolface orientation and recommended toolface orientation.

18. The method of claim 17, further comprising providing the difference to an evaluator.

19. The method of claim 12, wherein adjusting the drilling apparatus comprises adjusting the quill.

20. The method of claim 12, wherein the actual toolface orientation data and recommended toolface orientation data each independently comprises gravity-based toolface orientation data, magnetic-based toolface orientation data, azimuth toolface orientation data, inclination toolface orientation data, or a combination thereof.

* * * * *